United States Patent [19]

Shin

[11] Patent Number: 4,616,119

[45] Date of Patent: Oct. 7, 1986

[54] UNIFORMLY HEATING APPARATUS FOR MICROWAVE OVENS

[75] Inventor: Kyu C. Shin, Seoul, Rep. of Korea

[73] Assignee: Gold Star Co., Ltd., Seoul, Rep. of Korea

[21] Appl. No.: 687,565

[22] Filed: Dec. 28, 1984

[30] Foreign Application Priority Data

Dec. 31, 1983 [KR] Rep. of Korea ..... 6379/1983[U]

[51] Int. Cl.[4] ..... H05B 6/74

[52] U.S. Cl. ..... 219/10.55 F; 219/10.55 R

[58] Field of Search ..... 219/10.55 F, 10.55 R, 219/10.55 E, 10.55 A

[56] References Cited

U.S. PATENT DOCUMENTS

| | | | |
|---|---|---|---|
| 3,300,615 | 1/1967 | Smith | 219/10.55 F |
| 4,019,009 | 4/1977 | Kusunoki et al. | 219/10.55 F |
| 4,037,071 | 7/1977 | Kaufman, Jr. et al. | 219/10.55 F |
| 4,121,078 | 10/1978 | Takano et al. | 219/10.55 F |
| 4,173,716 | 11/1979 | Takahashi | 219/10.55 F |
| 4,176,266 | 11/1979 | Kaneko et al. | 219/10.55 F |
| 4,185,181 | 1/1980 | Kaneko et al. | 219/10.55 F |
| 4,223,194 | 9/1980 | Fitzmayer | 219/10.55 F |

*Primary Examiner*—Philip H. Leung

*Attorney, Agent, or Firm*—Birch, Stewart, Kolasch & Birch

[57] ABSTRACT

A microwave oven is provided, which includes a microwave generator and a wave guide through which a microwave from the generator is guided into a cavity such that an object charged in the cavity is heated. The microwave oven comprises a uniform heating apparatus. The apparatus includes a guide plate mounted on an inner wall of the cavity and connected to the wave guide, a guide space defined between the guide plate and the inner wall of the cavity and adapted to change the microwave discharged from the wave guide into a standing wave, and a fan disposed in the guide space and adapted to disperse the standing wave into the cavity.

7 Claims, 11 Drawing Figures

FIG. 1(a)
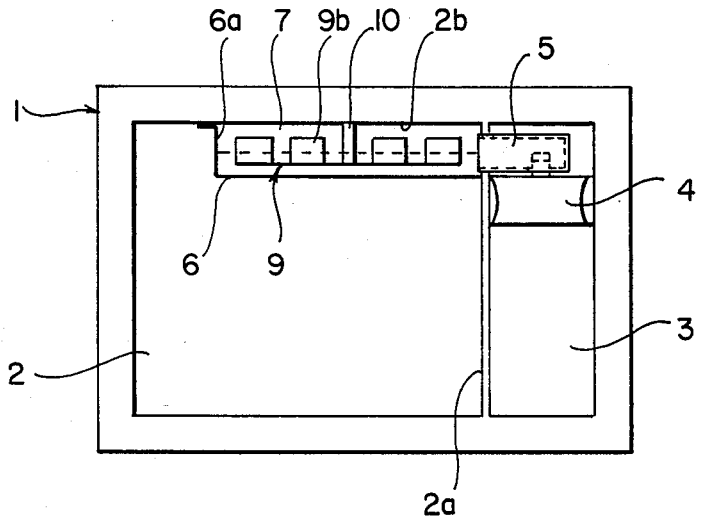
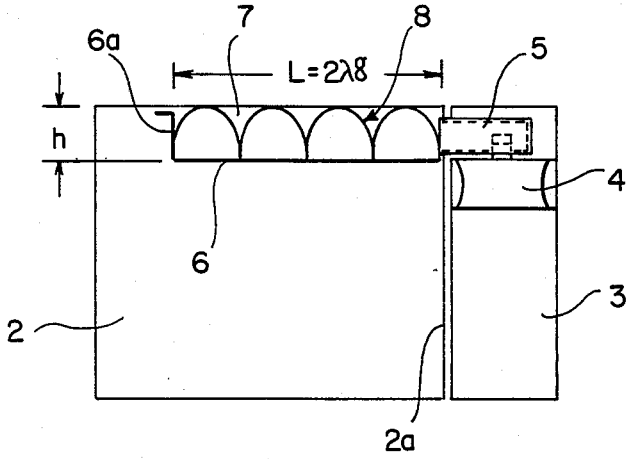
FIG. 1(b)

FIG. 2(a)
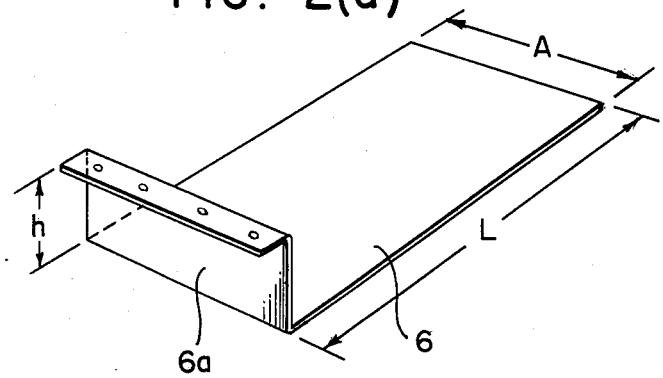
FIG. 2(b)
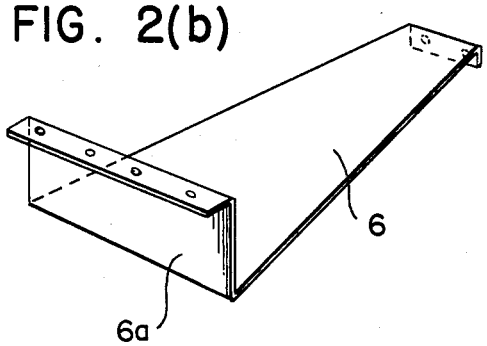
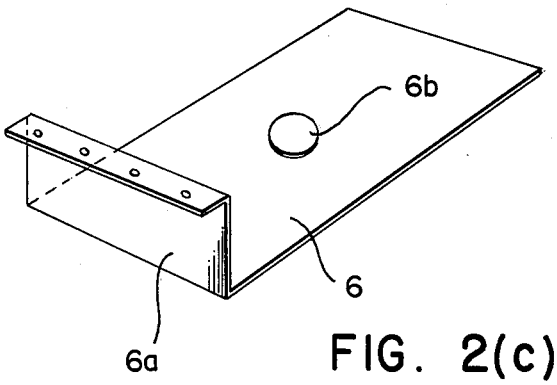
FIG. 2(c)
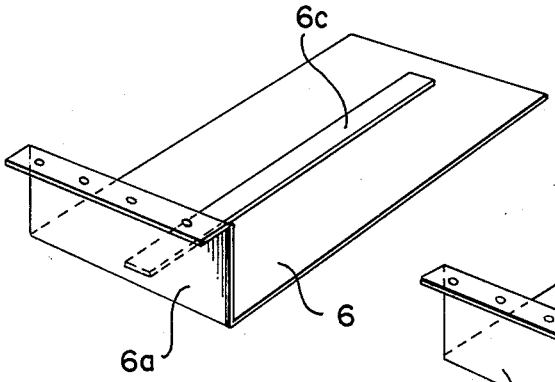
FIG. 2(d)
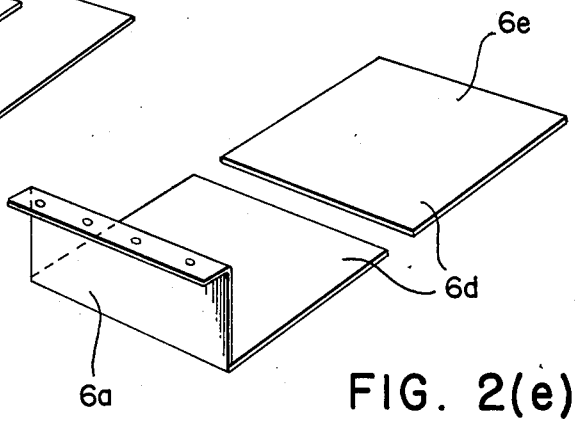
FIG. 2(e)

FIG. 5
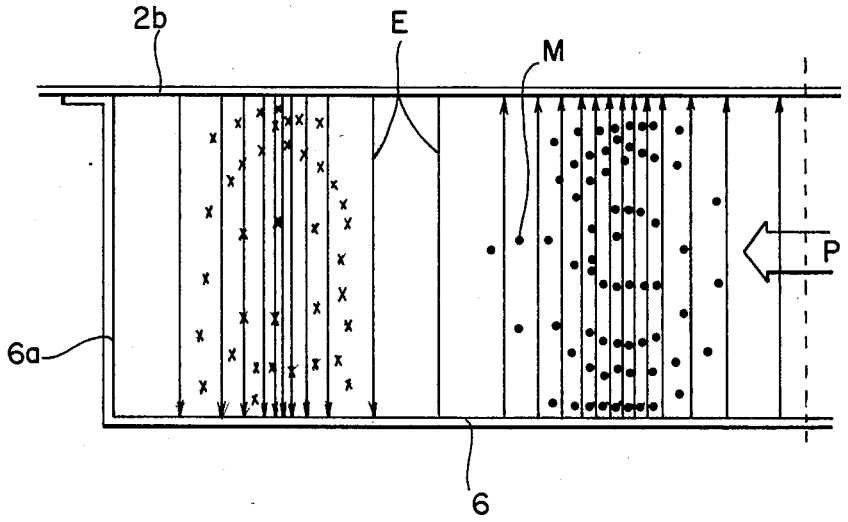
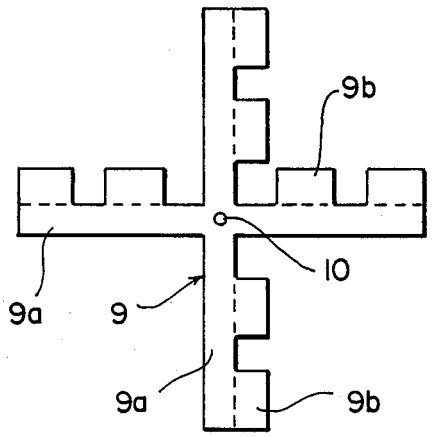
FIG. 6

UNIFORMLY HEATING APPARATUS FOR MICROWAVE OVENS

BACKGROUND OF THE INVENTION

1. Field of the Invention

The present invention relates to an oven including a microwave generator, and more particularly to a uniform heating apparatus for the oven comprising a metal-made guide plate disposed at a certain position in the interior of the oven and adapted to generate a standing wave, and a fan for uniformly dispersing the standing wave into a cavity of the oven, so that the wave effectively penetrates into an object to be heated, such as a food.

2. Description of the Invention

Conventional ovens have a disadvantage in that food has to be heated a a different rate, depending on the kind, the volume, and the shape thereof. This results from a concentrated dispersion of a standing wave at several areas in the interior of the cavity due to the nature of microwave, causing excess absorption of energy at these areas.

Accordingly, it is required that the standing wave be concenturated at a place near to a wave guide in the oven and then uniformly dispersed, prior to the penetration thereof into food, so that the food is uniformly heated to provide the effective cooking thereof. The requirement for the uniform heating of food is that a change of the output of the oven be decreased, which depends upon the change of position of the load in a plane, that an absorption of the output be uniformly effected throughout the overall height of the load, and that an absorption of the output be uniformly effected throughout all positions in the load, irrespective of the size, the shape and the kind of load.

SUMMARY OF THE INVENTION

Accordingly, an object of the present invention is to provide a uniform heating apparatus for microwave ovens, which satisfies the above-mentioned requirements.

In a microwave oven, distribution of microwave is greatly varied, depending on loading and unloading of the oven. When the oven is loaded, the distribution of microwave is also varied, depending upon the position of the load. As a result, when food is loaded and cooked in a conventional oven, the food is burned due to the partial heat concentration therein at a certain area which is caused by the property of microwave. When the position of load is changed, cooking time is naturally changed due to the change of output. Eventually, it is difficult to provide an effective cooking of food.

As mentioned above, the object of the present invention is to overcome these problems. In accordance with the present invention, a uniform heating apparatus for microwave ovens is provided, which apparatus comprises a guide plate connected to a wave guide and adapted to generate a standing wave, and a fan for uniformly dispersing the standing wave into a cavity of the oven, so as to penetrate effectively the wave into the food. The guide plate may be made by extending the wave guide.

Other objects, and advantages features will become more apparent from the following description considered in connection with the accompanying drawings.

BRIEF DESCRIPTION OF THE DRAWINGS

FIG. 1(*a*) is schematic cross-sectional view of a microwave oven provided with a guide plate according to the present invention;

FIG. 1(*b*) is an view showing an intensity of the electric field the standing wave along the guide plate, when the length L of guide plate is set by 2 λg FIGS. 2(*a*), (*b*), (*c*), (*d*), and (*e*) are perspective views of the modified guide plates according to the different embodiments, respectively;

FIG. 5 is a view showing each direction of electric field, magnetic field, and output of the standing wave on the guide plate; and FIG. 6 is a plan view of a dispersion fan according to an embodiment of the present invention.

DETAILED DESCRIPTION OF THE INVENTION

Figure 3:
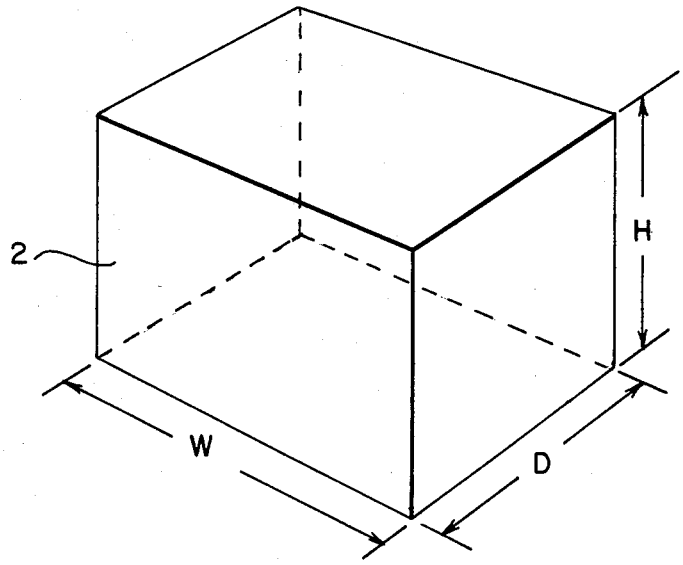
FIG. 3 is a perspective view showing the cavity of the oven having the length W, the depth D, and the height H.
Figure 4:
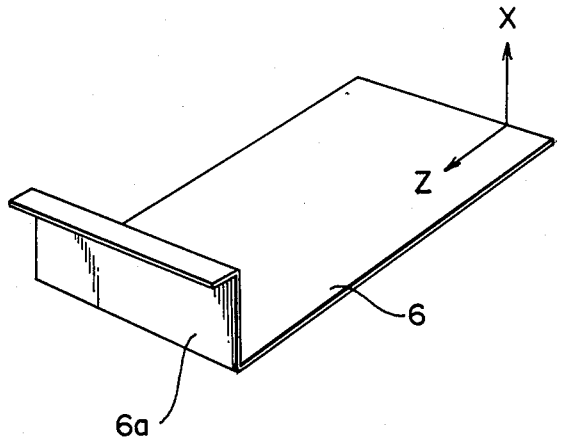
FIG. 4 is a view showing coordinates X and Z of the standing wave on the guide plate in a vertical direction and a longitudinal direction, respectively.

FIG. 1(*a*) is a cross-sectional view of a microwave oven, including a guide plate according to the present invention. The oven comprises an oven body 1 including a cavity 2 capable of receiving food to be cooked therein and a control unit-receiving chamber 3. At the top of a side wall of the cavity 2, a wave guide 5 having a rectangular cross-section is provided to guide, into the cavity 2, a microwave generated from a magnetron 4 disposed in the control unit-receiving chamber 3.

In accordance with the present invention, the above-mentioned oven includes a metal-made guide plate 6 disposed near to the top wall 2*b* of the interior of the cavity 2. One end of the guide plate 6 is upwardly curved to form an upstanding wall 6*a*, while the other end of the guide plate 6 is connected to the wave guide 5. Accordingly, a microwave discharged through the wave guide 5 is guided in a concentrated form into a guide space 7 defined between the guide plate 6 and the top wall of the cavity 2, so that a standing wave 8 (FIG. 1*b*) is generated in the guide space 7. A wave-dispersing fan 9 the is disposed at the middle of guide space 7 to disperse and distribute the standing wave 8 uniformly in the cavity 2.

The guide plate 6 may be formed from a rectangular plate as shown in FIG. 2(*a*), or alternatively formed from a trapezoidal plate as shown in FIG. 2(*b*). A part of the output may be downwardly discharged from the guide plate 6 through a circular aperture 6*b* or a slit 6*c* formed of a suitable size at the middle of the guide plate 6, as shown in FIGS. 2(*c*) and 2(*d*), respectively. Alternatively, this can be accomplished by providing two guide plates (6*d*) and (6*e*) spaced from each other and discharging a part of the output through the space between the guide plates (6*d*) and (6*e*).

The guide plates have various sizes and shapes, depending on a volume of the cavity 2 and a desired property can be obtained by controlling the volume of the guide space 7 determined by a length L and a width A of the guide plate 6 and height h of the upstanding wall 6*a*. In the case of mounting the guide plate 6 adjacent to the wave guide 5, the output flow is greatly divided into two flows one flow along the guide plate 6 and the other directly into the cavity 2.

In the case of commercial ovens, a microwave which is generated from the magnetron 4 and guided through the wave guide 5 has a TE 10 mode. This mode is continued along the guide plate 6. In this case, width A of the guide plate 6 is an important factor determining this mode.

In determining the width A of the guide plate 6, it is desirable to take into account the depth of the cavity 2, because the guide space 7, defined by said guide plate 6, is open at both sides thereof, different from the rectangular wave guide, and a top surface is defined by the top wall 2*b* of the cavity 2.

If the cavity 2 has the length W, the depth D, and the height H as shown in FIG. 3, an effective length a of the width A of guide plate 6 is substantially expressed as follows:

$$A_{eff}=a\cong(A+D)/2$$

In this case, if vertical and longitudinal coordinates on the guide plate 6 are indicated by X and Z respectively, distribution of the electric field generated on the guide plate 6 can be expressed by the following formula:

$$\mathrm{Sin}\left(\frac{\pi}{a}\right) Xe^{-j\beta z}$$

The output flows longitudinally along the guide plate 6. $\beta$ is a propagation constant and is expressed by $\beta=(2\pi)/(2g)$, if the guide wave length of TE 10 mode wave is $\lambda g$.

The guide wave length 2g of TE 10 mode wave can be also expressed by $$\lambda g = \lambda/\sqrt{1-\left(\frac{\lambda}{2a}\right)^2}\ .$$

The frequency used in a commercial oven is 2.455 GHZ, and in this case the value $\lambda$ is 12.3 cm. FIG. 5 shows each direction of the electric Field E, the magnetic Field M, and the output P which are generated on the guide plate 6, when the length L of the guide plate is 2 $\lambda g$. In this case, the number of amplitudes of the generated standing wave will be 4 [FIG. 1(*b*)].

Generally, if the length of the guide plate is set equal to $N(\lambda g/2)$, the number of amplitudes of the generated standing wave will be N.

The length of the guide plate should be selected to be a multiple of the guide wave length, so as to provide a maximum amplitude of the standing wave. If the length of the guide plate does not become a multiple of the guide wave length, the amplitude of standing wave is naturally decreased and, thus, it is difficult to provide an effective dispersion of wave. On the other hand, the standing wave can be defined by a composite wave of an incident wave from the wave guide 5 and a reflecting wave from the upstanding wall 6*a* of the guide plate 6 disposed opposite to said wave guide 5. This composite wave can be considered identical with that of the two incident waves which are generated from two respective magnetrons, in the case that the magnetrons are disposed at both sides of the guide plate 6, respectively. Thus, the advantageous effect obtained by using the guide plate can be considered equal to that realized in the use of two magnetrons. These effects can be also increased by dispersion forcibly the wave by means of the fan 9.

In this manner, the standing wave which is generated in the guide space between the guide plate 6 and the top wall 2*b* (of the cavity 2) can be uniformly dispersed into the cavity 2 by the fan 9. The efficiency of wave dispersion is varied, depending on the size of the fan 9 and the vane angle thereof. Therefore, the efficiency can be optimal, by determining the above suitable factors.

In the case when the length of the guide plate 6 is 2 $\lambda g$, the size of the fan 9 can be determined as follows. FIG. 6 shows a preferred embodiment of the fan 9, in which four vanes 9*a* are radially disposed around a rotatable shaft 10 and each vane includes two vain plates 9*formed integrally with each other. When the rotation center of the fan 9 is disposed at the center of the guide space 7, each vane plate 9b* of the vane 9*a* serves to disperse the standing wave corresponding to one amplitude among four amplitudes of the standing wave. Accordingly, if the length of the guide plate 6 is 2 $\lambda g$, the height of the upstanding wall 6*a* is h, and the length and the height of each vane plate 9*b* of the fan 9 are set equal to about 0.72 $\lambda g/2$ and 0.72 h respectively, the efficiency of the standing wave dispersion of 90% and higher can be obtained. In the case that the length of the guide plate 6 is N ($\lambda g/2$), the same principle can also apply.

The above-mentioned apparatus of the present invention is particularly useful to a side-feeding-type oven; however, it is also effectively appliable to other feeding-type ovens.

In accordance with the present invention, it is possible to uniformly and effectively disperse the microwave into the interior of the oven cavity and, in cooking of food, it is also possible to uniformly heat the food without causing any problems of being partially burned or half-boiled. Accordingly, the efficiency in cooking is considerably improved. In addition, the apparatus of the present invention is easily applicable to any kind of oven, bacause it has a simple construction for mounting only the guide plate.

What is claimed is:

1. A microwave oven comprising a cavity a microwave generator and a wave guide through which a microwave from said microwave generator is guided into said cavity, so that the microwave heats an object to be heated in said cavity, a uniform heating apparatus including a guide plate mounted on an inner wall of said cavity and connected to said wave guide, a guide space defined between said guide plate and said inner wall of said cavity for converting the microwave into a standing wave having a predetermined wavelength in said guide space and a fan disposed in said guide space for dispersing said standing wave into said cavity, the length of said guide plate being a multiple of ½ the wave length of said standing wave generated within said guide space.

2. The microwave oven of claim 1, wherein said guide plate has a slit disposed at a middle thereof for discharging a part of said standing wave.

3. The microwave oven of claim 1, wherein said guide plate is made of a rectangular plate having an upstanding wall at one end of said guide plate.

4. The microwave oven of claim 1, wherein said guide plate is made of a trapezoidal plate having an upstanding wall at one end of said guide plate.

5. The microwave oven of claim 1, wherein said guide plate has at a middle thereof an aperture for discharging a part of said standing wave.

6. The microwave oven of claim 1, wherein said guide plate comprises two plates spaced from each other.

7. The microwave oven of claim 1 wherein said fan is positioned such that the center thereof is at the center of said guide space, and includes a pluarlity of vanes disposed around a rotatable shaft, each vane having vane plates, the number of said vane plates being equal to said multiple of $\frac{1}{2}$ the wave length of said standing wave.

* * * * *